US007597749B2

(12) United States Patent
Paterson et al.

(10) Patent No.: US 7,597,749 B2
(45) Date of Patent: Oct. 6, 2009

(54) FRAME FOR ELECTROSTATIC PRECIPITATOR CELL

(75) Inventors: Christopher M. Paterson, Biloxi, MS (US); Dennis T. Lamb, Long Beach, MS (US); Bruce M. Kiern, Gulfport, MS (US); Owen T. Bourgeois, Pass Christian, MS (US)

(73) Assignee: Oreck Holdings, LLC, Cheyenne, WY (US)

( * ) Notice: Subject to any disclaimer, the term of this patent is extended or adjusted under 35 U.S.C. 154(b) by 367 days.

(21) Appl. No.: 11/488,301

(22) Filed: Jul. 18, 2006

(65) Prior Publication Data

US 2008/0017035 A1 Jan. 24, 2008

(51) Int. Cl.
*B03C 3/47* (2006.01)

(52) U.S. Cl. ..... 96/39; 55/DIG. 31; 96/41; 96/86; 96/87; 96/94

(58) Field of Classification Search ..... 96/29–31, 96/39–41, 81, 83–87, 94; 55/503, 511, DIG. 31
See application file for complete search history.

(56) References Cited

U.S. PATENT DOCUMENTS 3,041,807 A * 7/1962 Getzin et al. ..... 96/86
3,175,341 A * 3/1965 Winter ..... 96/86
3,520,111 A * 7/1970 Revell et al. ..... 96/86
4,253,852 A 3/1981 Adams
4,325,714 A * 4/1982 Wooldridge ..... 96/86
4,326,861 A 4/1982 Matsumoto
4,473,382 A 9/1984 Cheslock
4,516,991 A 5/1985 Kawashima
4,976,753 A * 12/1990 Huang ..... 96/58
5,035,728 A 7/1991 Fang
5,290,343 A * 3/1994 Morita et al. ..... 96/39
5,628,818 A * 5/1997 Smith et al. ..... 96/30
6,176,977 B1 1/2001 Taylor et al.
6,679,940 B1 * 1/2004 Oda ..... 96/55

* cited by examiner

*Primary Examiner*—Richard L Chiesa
(74) *Attorney, Agent, or Firm*—Winston & Strawn LLP; Richard P. Gilly

(57) ABSTRACT

A frame for an electrostatic precipitator cell is provided according to an embodiment of the invention. The frame in one embodiment includes a first frame portion adapted to at least partially receive the electrostatic precipitator cell and a second frame portion adapted to at least partially receive the electrostatic precipitator cell. The second frame portion assembles to the first frame portion to form the frame. The frame includes one or more side portions, an open top end, and an open bottom end. The frame receives and holds the electrostatic precipitator cell.

22 Claims, 15 Drawing Sheets

FRAME FOR ELECTROSTATIC PRECIPITATOR CELL

TECHNICAL FIELD

The present invention relates to a frame, and more specifically to a frame for an electrostatic precipitator cell.

BACKGROUND OF THE INVENTION

Air cleaners and purifiers are widely used for removing foreign substances from the air. The foreign substances can include pollen, dander, smoke, pollutants, dust, etc. In addition, an air cleaner can be used to circulate room air. An air cleaner can be used in many settings, including at home, in offices, etc.

One type of air cleaner is an electrostatic precipitator. An electrostatic precipitator operates by creating an electrical field. Dirt and debris in the air becomes ionized when it is brought into the electrical field by an airflow. Charged positive and negative electrodes in the electrostatic precipitator air cleaner, such as positive and negative plates, attract the ionized dirt and debris. The electrodes can release the dirt and debris when not powered, and the electrostatic precipitator can be removed and cleaned. Because the electrostatic precipitator comprises electrodes or plates through which airflow can easily and quickly pass, only a low amount of energy is required to generate the airflow. As a result, foreign objects in the air can be efficiently and effectively removed without the need for a mechanical filter element.

In the prior art, an electrostatic precipitator is typically assembled by inserting a series of electrode plates into an air cleaner chassis. Alternatively, in the prior art the plates are assembled together into some manner of integral unit. The chassis can include plastic end plates that receive and hold the electrode plates. Alternatively, the prior art electrostatic precipitator can include electrode plates that are welded or bonded into a fixed unit.

The prior art has drawbacks. The prior does not include a frame that forms an electrostatic precipitator as an integral unit. In the prior art, there are no retainer devices that hold the frame into a chassis. In the prior art, the electrostatic precipitator cannot be front loaded (i.e., push in, pull out). In the prior art, the electrostatic precipitator rests in the chassis on its bottom surface.

SUMMARY OF THE INVENTION

A frame for an electrostatic precipitator cell is provided according to an embodiment of the invention. The frame comprises a first frame portion adapted to at least partially receive the electrostatic precipitator cell and a second frame portion adapted to at least partially receive the electrostatic precipitator cell. The second frame portion assembles to the first frame portion to form the frame. The frame includes one or more side portions, an open top end, and an open bottom end. The frame receives and holds the electrostatic precipitator cell:

A frame for an electrostatic precipitator cell is provided according to an embodiment of the invention. The frame comprises a frame portion adapted to receive the electrostatic precipitator cell. The frame portion includes a plurality of side portions, an open top end, and an open bottom end. The frame further comprises two or more support projections formed on the frame portion and configured to suspend the frame portion and the electrostatic precipitator cell when positioned in the frame.

A frame for an electrostatic precipitator cell is provided according to an embodiment of the invention. The frame comprises a frame portion adapted to receive the electrostatic precipitator cell. The frame portion includes a plurality of side portions, an open top end, and an open bottom end. The frame further comprises a handle formed on a side portion of the plurality of side portions.

A frame for an electrostatic precipitator cell is provided according to an embodiment of the invention. The frame comprises a frame portion adapted to receive the electrostatic precipitator cell. The frame portion includes a plurality of side portions, an open top end, and an open bottom end. The frame further comprises one or more retainer devices formed on the frame portion. The one or more retainer devices are adapted to engage an air cleaner chassis.

A frame for an electrostatic precipitator cell is provided according to an embodiment of the invention. The frame comprises a frame portion adapted to receive the electrostatic precipitator cell. The frame portion includes a plurality of side portions, an open top end, and an open bottom end. The frame further comprises a plurality of ground element apertures formed in substantially opposing regions of the frame portion. The plurality of ground element apertures are adapted to receive corresponding corona ground elements.

A frame for an electrostatic precipitator cell is provided according to an embodiment of the invention. The frame comprises a frame portion adapted to receive the electrostatic precipitator cell. The frame portion includes a plurality of side portions, an open top end, and an open bottom end. The frame further comprises a plurality of ground element apertures formed in substantially opposing regions of the frame portion. The plurality of ground element apertures are adapted to receive corresponding corona ground elements. The frame further comprises a plurality of weep holes. A ground element aperture includes a weep hole that drains moisture from the ground element aperture.

A frame for an electrostatic precipitator cell is provided according to an embodiment of the invention. The frame comprises a frame portion adapted to receive the electrostatic precipitator cell. The frame portion includes a plurality of side portions, an open top end, and an open bottom end. The frame further comprises a plurality of slot wells formed in substantially opposing regions of the frame portion. A slot well of the plurality of slot wells is adapted to receive a corresponding corona charge element. The frame further comprises a plurality of charge element slots leading from an edge of the frame portion to the plurality of slot wells.

A method of affixing an electrostatic precipitator assembly in an air cleaner chassis is provided according to an embodiment of the invention. The method comprises providing a frame, inserting an electrostatic precipitator cell into the frame to form the electrostatic precipitator assembly, and inserting the frame into an electrostatic precipitator receptacle of the air cleaner chassis in order to assemble the electrostatic precipitator assembly to the air cleaner chassis.

BRIEF DESCRIPTION OF THE DRAWINGS

The same reference number represents the same element on all drawings. It should be noted that the drawings are not necessarily to scale.

DETAILED DESCRIPTION OF THE INVENTION

FIGS. 1-15 and the following descriptions depict specific embodiments to teach those skilled in the art how to make and use the best mode of the invention. For the purpose of teaching inventive principles, some conventional aspects have been simplified or omitted. Those skilled in the art will appreciate variations from these embodiments that fall within the scope of the invention. Those skilled in the art will also appreciate that the features described below can be combined in various ways to form multiple variations of the invention. As a result, the invention is not limited to the specific embodiments described below, but only by the claims and their equivalents.

Figure 1:
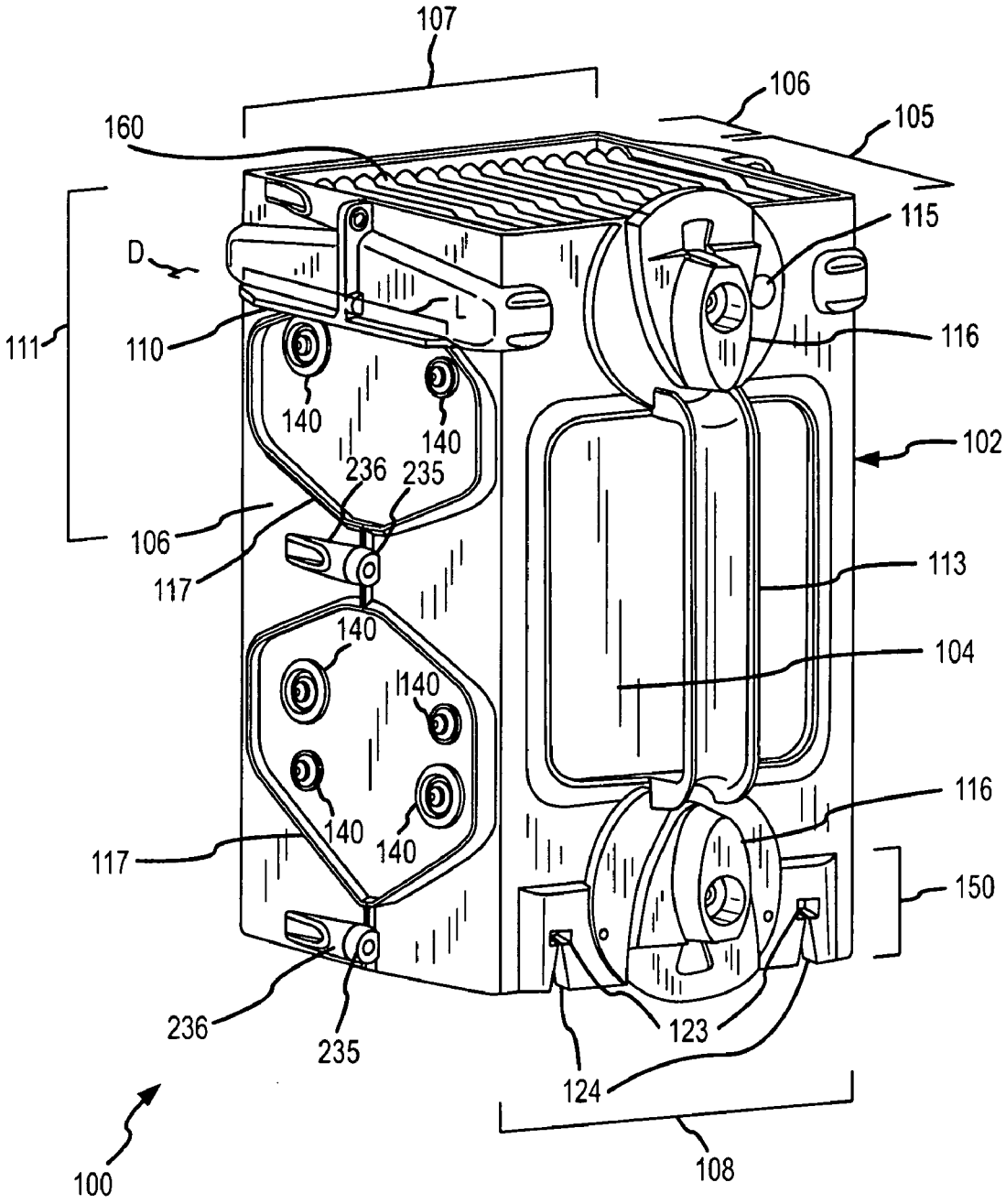
FIG. 1 shows an electrostatic precipitator assembly according to an embodiment of the invention.

FIG. 1 shows an electrostatic precipitator assembly 100 according to an embodiment of the invention. The electrostatic precipitator assembly 100 includes a frame 102 and an electrostatic precipitator cell 104 within the frame 102. This figure shows a series of plates 160 that make up the electrostatic precipitator cell 104. In addition, the electrostatic precipitator cell 104 in some embodiments can include a preionizer 930 (see FIG. 9). The frame 102 can include one or more side portions 106, an open top end 107, and an open bottom end 108. The top and bottom openings 107 and 108 enable airflow to pass through the electrostatic precipitator cell 104. In addition, the frame 102 can further include two or more support projections 110, a handle 113, one or more retainer devices 116, and side openings 117. Furthermore, the frame 102 can include a plurality of ground element apertures 120 and a plurality of slot wells 123 and corresponding charge element slots 124. A charge element slot 124 leads from an edge of the frame 102 to a slot well 123.

In one embodiment, the frame 102 is formed of an electrically insulating material. However, it should be understood that any suitable material can be used for the frame 102.

The frame 102 receives and holds the electrostatic precipitator cell 104. In one embodiment, the electrostatic precipitator cell 104 is held in the frame 102 by a friction fit. The frame 102 can therefore be at least partially flexible, and can fit tightly to the electrostatic precipitator cell 104. The frame 102 in this embodiment can comprise a single portion, for example.

In another embodiment, the frame 102 clamps onto the electrostatic precipitator cell 104. In this second embodiment, the frame 102 comprises a first frame portion 105 and a second frame portion 106. The first frame portion 105 and the second frame portion 106 can comprise substantially equal portions (i.e., first and second frame halves 105 and 106), or can comprise unequal portions. The second frame portion 106 assembles to the first frame portion 105 to form the frame 102. The first frame portion 105 and the second frame portion 106 can further include two or more first assembly ear portions 235, two or more second assembly ear portions 236, and two or more fasteners (not shown). The fasteners can affix the two or more first assembly ear portions 235 to the two or more second assembly ear portions 236. In one embodiment, the fasteners removably affix the first frame portion 105 and the second frame portion 106, although alternatively the fasteners can permanently affix the two portions. The fastener in one embodiment comprises a screw. However, it should be understood that other fasteners are contemplated, such as threaded bolts and nuts, rivets, spring clips, snap rivets, snap-fit devices, etc., and are within the scope of the description and claims.

The frame 102 includes two or more support projections 110. The support projections 110 can comprise projections formed on the frame 102. The support projections 110 can comprise projections that have an outward dimension D and a length L. The support projections 110 are configured to slide into and be received by the projection channels 1407 of the air cleaner 1400 (see FIGS. 14-15). The support projections 110 can therefore be used by the chassis 1301 in order to hold, retain, and steady the electrostatic precipitator assembly 100.

In one embodiment, the support projections 110 are formed substantially at a top region 111 of the frame 102. However, it should be understood that the support projections 110 can be located anywhere on the frame 102. In the embodiment that includes the first frame portion 105 and the second frame portion 106, four support projections 110 can be formed on the frame 102 (i.e., two on each frame portion).

The handle 113 can comprise an integral portion of the frame 102 (shown), or can be permanently or removably affixed to the frame 102. The handle 113 enables the electrostatic precipitator assembly 100 to be easily grasped and manipulated and can be grasped and used to insert and remove the electrostatic precipitator assembly 100 from the air cleaner 1400. The handle 113 advantageously enables easy insertion of the electrostatic precipitator assembly 100 into the air cleaner. In addition, the handle 113 enables a user to more easily and reliably grip the electrostatic precipitator assembly 100 during washing, cleaning, or other servicing operations.

In one embodiment, the one or more retainer devices 116 comprise one or more rotatable retainer devices 116. The one or more retainer devices 116 can removably affix the electrostatic precipitator assembly 100 in an electrostatic precipitator receptacle 1403 by engaging the air cleaner chassis 1301 (see FIGS. 11-13). Consequently, the electrostatic precipitator assembly 100 cannot vibrate or otherwise move out of position in the electrostatic precipitator receptacle 1403. Therefore, a person has to disengage the one or more retainer devices 116 in order to remove the electrostatic precipitator assembly 100.

The one or more side openings 117 reveal at least a portion of the electrostatic precipitator cell 104. For example, a side opening 117 can reveal (and provide access to) fasteners 140 of the electrostatic precipitator cell 104. A side opening 117 can also provide electrode contact access to the electrostatic precipitator cell 104 and will not trap and retain dirt when the electrostatic precipitator assembly 100 is being cleaned.

The frame 102 can include a thick wall portion 150. The thick wall portion 150 is formed on a side portion 106 where the corona charge elements 400 and the corona ground elements 500 will be received (see FIG. 9 and the accompanying discussion). The thick wall portion 150 can be of any thickness, and reinforces the frame 102 in order to enable tension to be placed on the corona charge elements 400.

Figure 9:
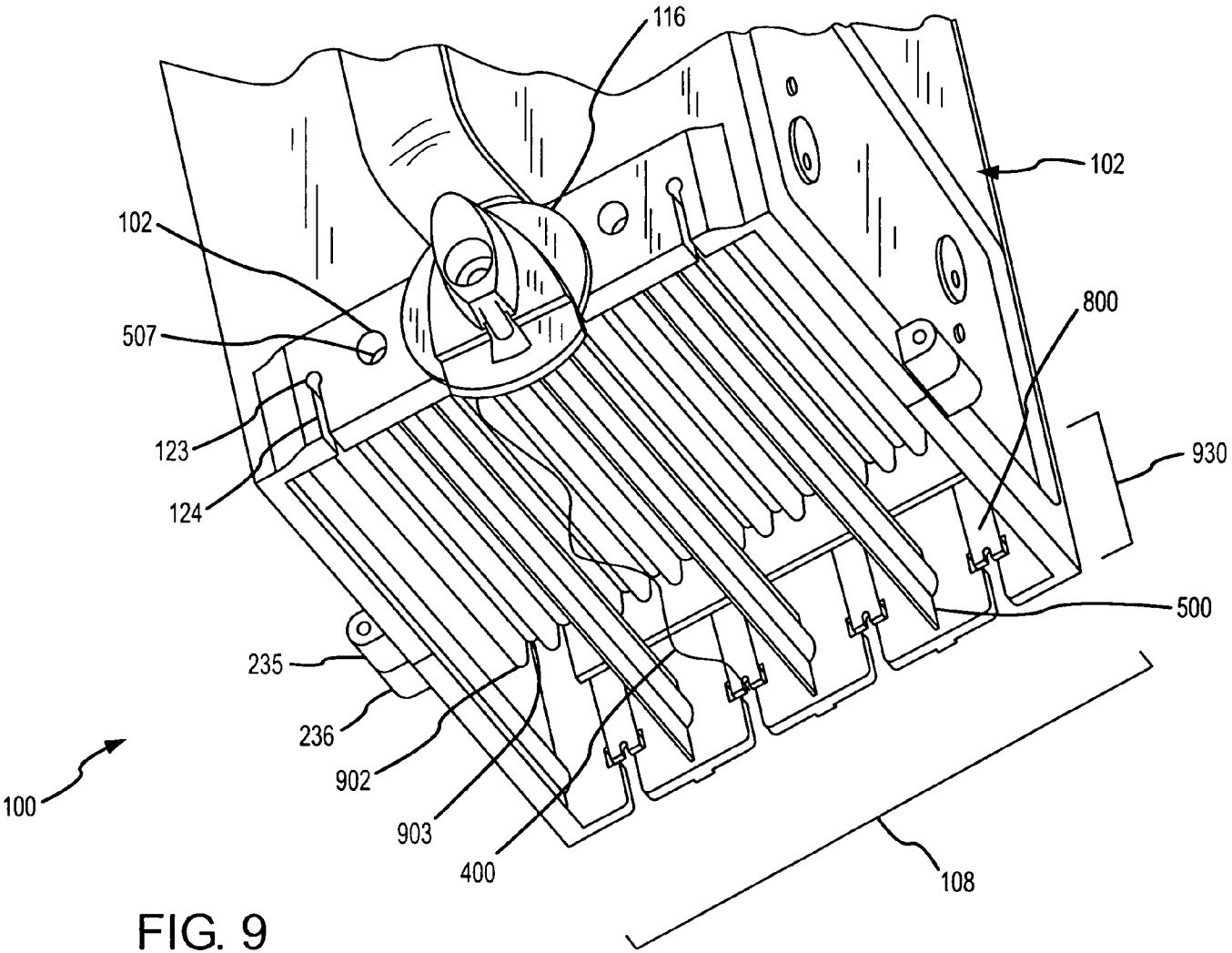
FIG. 9 is a bottom view of the electrostatic precipitator assembly of FIG. 1 looking up into the bottom opening.

One or more ground element apertures 120 are formed in the thick wall portion 150 and on the opposite frame side (see FIG. 9). The ground element apertures 120 can be substantially circular or rectangular, but can also have other shapes. The ground element aperture 120 can additionally be of a size to accept any manner of retainer 700 for a corona ground element 500 (see FIGS. 5A and 5B).

One or more slot wells 123 are also formed in the thick wall portion 150 and on the opposite frame side. The slot wells 123 receive a retaining body 404 formed on an end of a corona charge element 400 (see FIG. 4). A slot well 123 therefore comprises a through-hole of a size to accommodate a wire portion 402 of the corona charge element 400 but does not allow the retaining body 404 to pass. A slot well 123 is similar in form to a ground element aperture 120 (see FIG. 3 and the accompanying discussion). The slot well 123 further comprises a blind aperture of a larger size, wherein the blind aperture accepts the retaining body 404. In one embodiment, the blind aperture is deeper than the height of the retaining body 404. Therefore, the entire slot well 123 accepts and holds the retaining body 404, but wherein the retaining body 404 does not extend past an outer surface of the frame 102.

The slot wells 123 further include charge element slots 124 that lead from an edge (of the bottom opening 108) to a corresponding slot well 123. The charge element slots 124 are of a size to allow the wire portions 402 of the corona charge element 400 to pass.

The frame 102 can further include one or more weep holes 115 (see FIG. 1). The weep holes 115 can be located anywhere on the frame 102. The weep holes 115 enable liquids to drain from the frame 102, including when the electrostatic precipitator cell 104 is in place in the frame 102. The liquid can include cleaning liquids, condensation, etc. In addition, dust, dirt, and other debris can drain from the weep holes 115, such as during cleaning of the electrostatic precipitator assembly 100.

Figure 2:
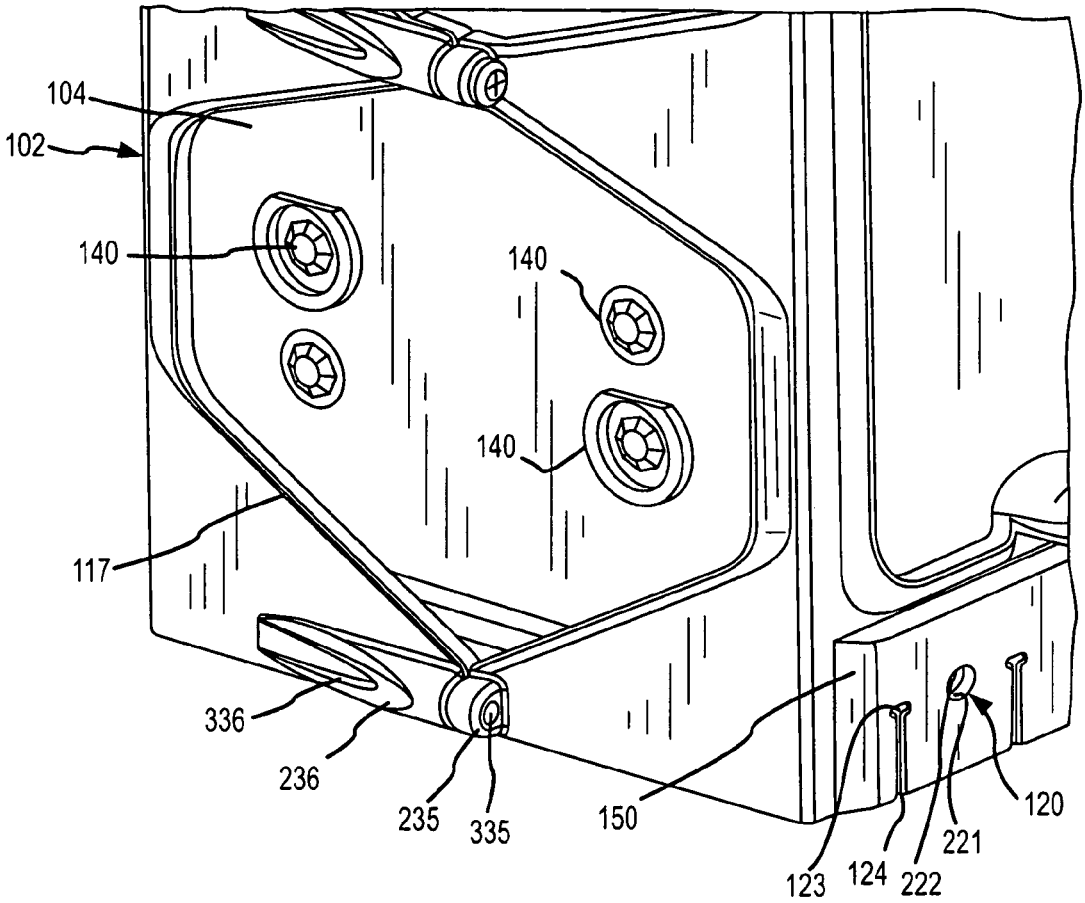
FIG. 2 shows detail of a portion of a frame according to an embodiment of the invention.

FIG. 2 shows detail of a portion of the frame 102 according to an embodiment of the invention. In this figure, it can be seen that the first and second assembly ears 235 and 236 can include fastener apertures 335 and 336, respectively. The fastener apertures 335 and 336 can receive a fastener. The fastener apertures 335 and 336 can comprise apertures of different sizes or of the same size.

The figure further shows the thick wall portion 150, which in one embodiment is included to reinforce the frame 102 where the corona charge elements 400 are retained by the frame 102. The ground element apertures 120, the slot wells 123, and the charge element slots 124 therefore can be formed in the thick wall portion 150. This figure shows the large blind aperture 221 and the small through aperture 222 that comprise a ground element aperture 120. The large blind aperture 221 can accommodate a retainer of a corona ground element 500.

Figure 3:
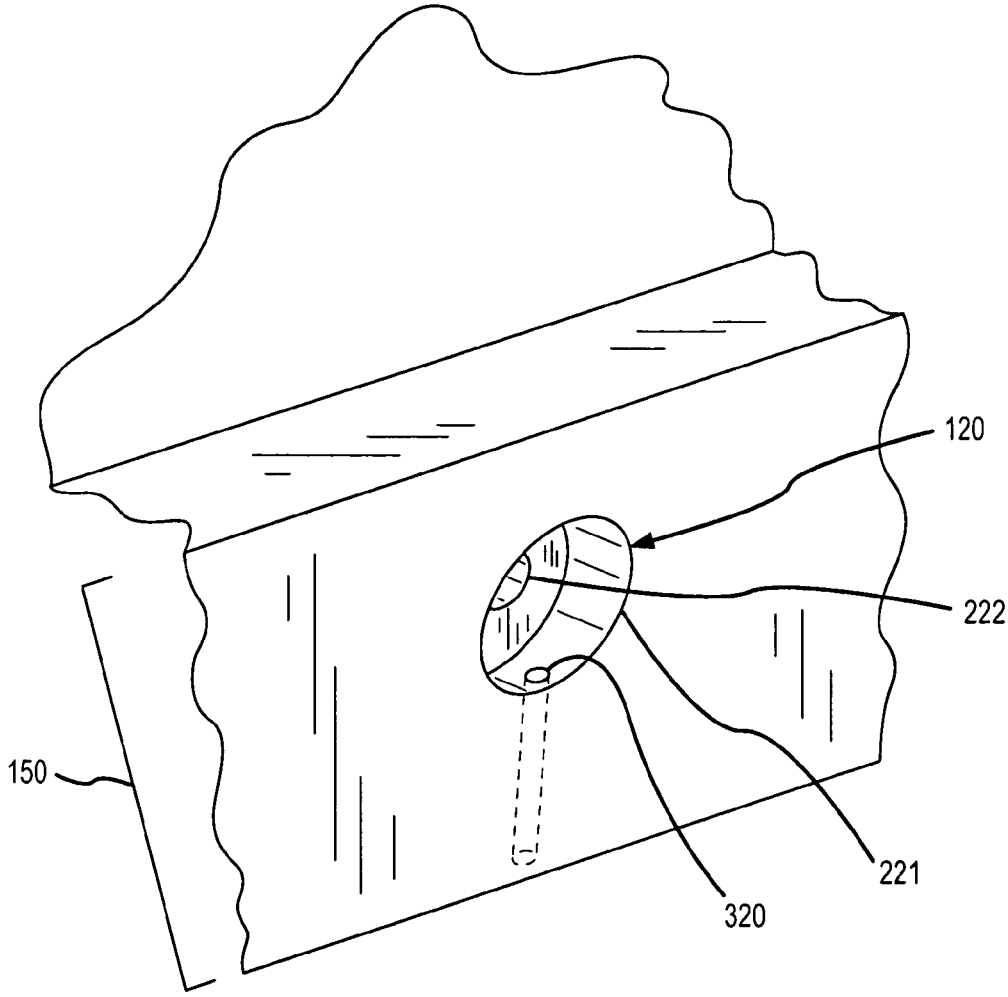
FIG. 3 is a breakout enlargement that shows detail of a ground element aperture according to an embodiment of the invention.

FIG. 3 is a breakout enlargement that shows detail of a ground element aperture 120 according to an embodiment of the invention. This figure again shows the large blind aperture 221 and the small through aperture 222 of the ground element aperture 120. This figure also shows a weep hole 320 that extends from the large blind aperture 221 to the bottom edge of the frame 102. The weep hole 320 is provided in order to drain any moisture that has accumulated in the ground element aperture 120. The draining of moisture aids in preventing and/or reducing arcing in the high voltage potential of the electrostatic precipitator cell 104.

Figure 4A:
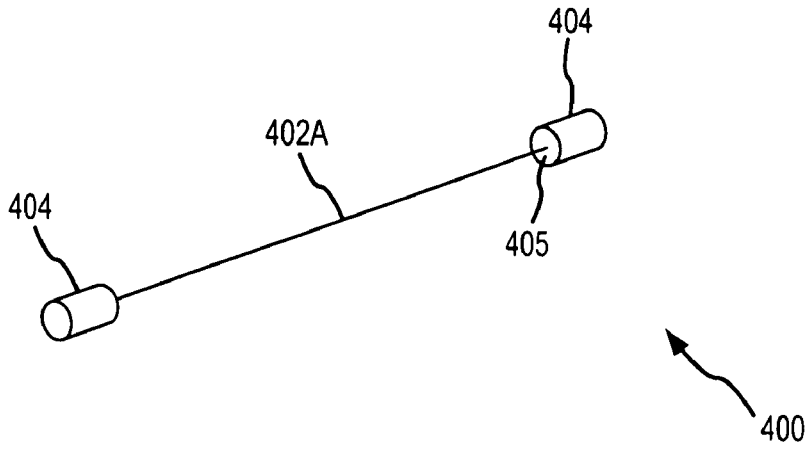
FIGS. 4A-4B show corona charge elements according to two embodiments of the invention.
Figure 4B:
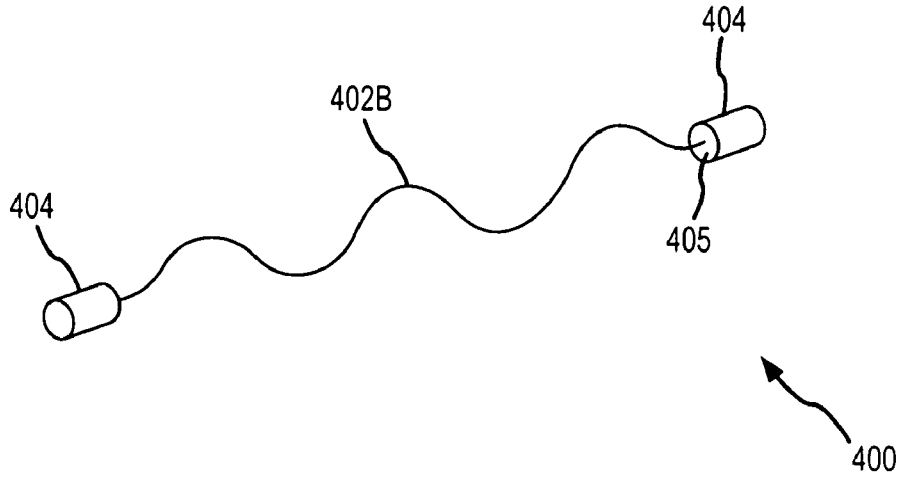

FIGS. 4A-4B show corona charge elements 400 according to two embodiments of the invention. In the two embodiments shown, a corona charge element 400 comprises an electrode wire configuration. The corona charge element 400 includes a wire portion 402 and two retaining bodies 404 formed on the ends of the wire portion 402. A retaining body 404 is used to trap and retain an end of the wire portion 402.

A retaining body 404 comprises a mass, shape, bead, barrel, block, billet, etc., that is substantially solid and that is larger than the wire portion 402. A retaining body 404 can comprise a shape that is substantially spherical, cylindrical, rectangular, irregular, etc. A retaining body 404 includes a substantial length, height, and depth. A retaining body 404 includes a contact face 405 that contacts a retaining surface of the electrostatic precipitator assembly 100. In one embodiment, the contact face 405 is substantially planar and extends substantially perpendicularly from the wire portion 402. Alternatively, the contact face 405 can curve or slope away from the wire portion 402. The contact face 405 in one embodiment includes a contact face area that is at least twice a cross-sectional area of the wire portion 402.

In use, the retaining body 404 is placed behind a retaining portion such as a wall or lip, wherein the wire portion 402 extends through some manner of slot or gap in the retaining portion. Consequently, the retaining body 404 can be trapped in order to retain the end of the corona charge element 400, and even can be used to place a tension force on the corona charge element 400.

In the embodiment of FIG. 4A, the corona charge element 400 includes a substantially straight wire portion 402A. In the embodiment of FIG. 4B, the wire portion 402B is substantially serpentine. The wire portion 402B in this embodiment may be substantially rigid or substantially inflexible in order to retain the serpentine shape.

The wire portion 402 can be formed of any metal or alloy composition, and can have any desired diameter and flexibility. The length of the corona charge element 400 can be such that the frame 102 places a tension on the corona charge element 400 when in place in the frame (see FIG. 9 and the accompanying discussion). The retaining bodies 704 are larger in diameter than the wire portion 402, and therefore can be used to restrain the corona charge element 400 by the two ends.

Figure 5A:
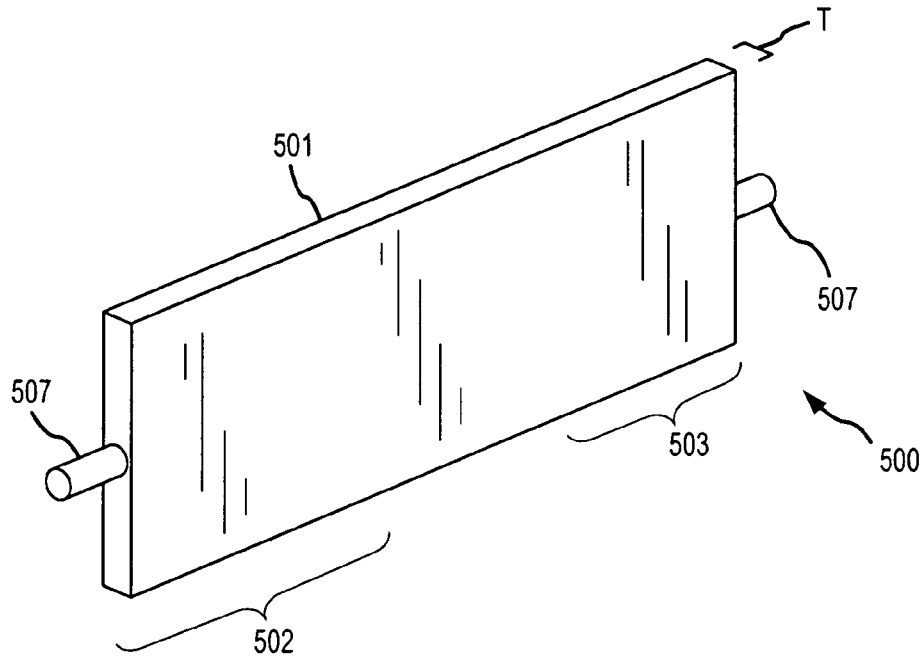
FIGS. 5A-5B show a corona ground element according to several embodiments of the invention.
Figure 5B:
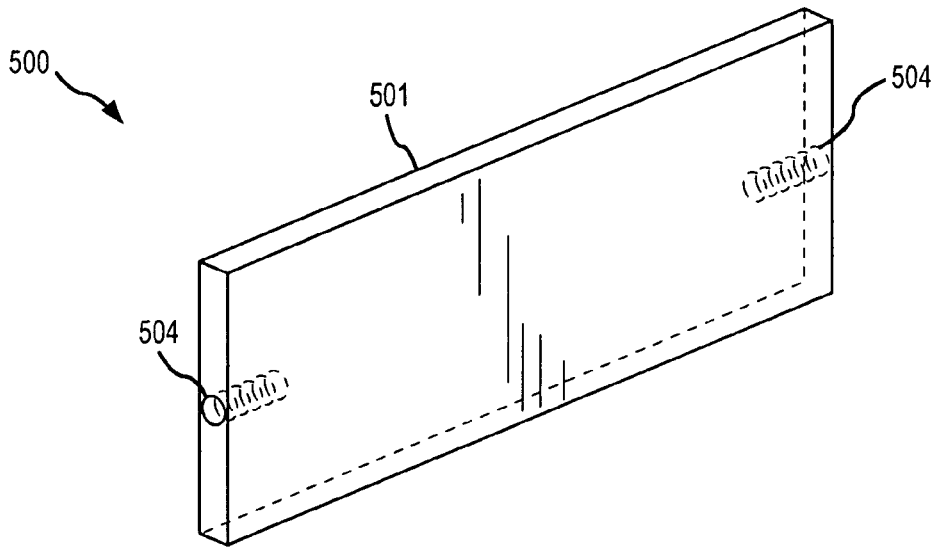

FIGS. 5A-5B show a corona ground element 500 according to several embodiments of the invention. In one embodiment, the corona ground element 500 comprises a corona plate configuration. The corona ground element 500 includes a substantially elongate body 501 including a proximate end 502, a distal end 503, a thickness T, and first and second projections 507 formed on the proximate end 502 and the distal end 503. In one embodiment, the projections 507 comprise shafts. In another embodiment, the projections 507 comprise hollow shafts, including shafts with threaded apertures, which can receive some manner of fastener. A fastener can comprise a rivet, screw, bolt, a stud with biased or spring portions, etc.

Figure 6D:
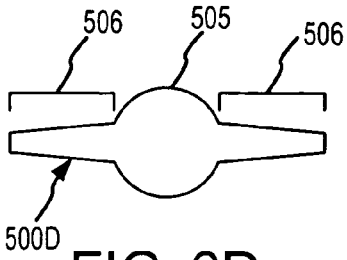
FIGS. 6A-6I show various cross-sectional shapes of the corona ground element according to various embodiments of the invention.
Figure 6A:
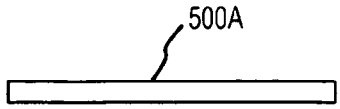
Figure 6B:
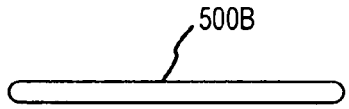
Figure 6E:
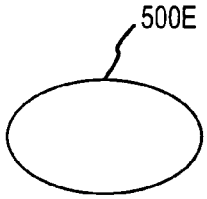
Figure 6F:
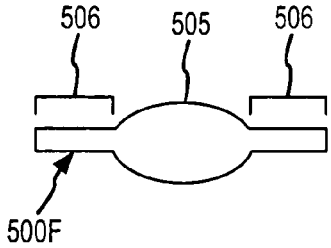
Figure 6G:
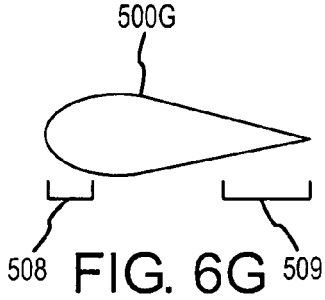
Figure 6C:
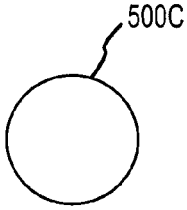
Figure 6H:
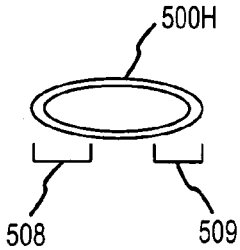

In one embodiment, the corona ground element 500 comprises a hollow body, such as a tube (see FIG. 6H). In one embodiment, the projections 507 comprise stub axles or support members that are used to retain the corona ground element 500 in the electrostatic precipitator assembly 100. In one embodiment, the projections 507 fit into ground element apertures 120 in the frame 102. The projections 507 may fit only part way into the ground element apertures 120.

FIG. 5B shows an alternative embodiment, wherein the body 501 includes threaded apertures 504. The threaded apertures 504 receive threaded fasteners that affix the corona ground element 500 in the electrostatic precipitator 300.

FIGS. 6A-6I show various cross-sectional shapes of the corona ground element 500 according to various embodiments of the invention. FIG. 6A shows a corona ground element 500A that has a planar shape, wherein the corona ground element 500A can be formed out of sheet material. FIG. 6B shows a corona ground element (plate) 500B that has a planar shape, but with rounded leading and trailing edges. The rounded leading and trailing edges may be desirable in reducing airflow drag and airflow turbulence through the pre-ionizer 930 (see FIG. 9). FIG. 6C shows a corona ground element 500C that has a substantially circular shape. FIG. 6D shows a corona ground element 500D that has a substantially circular central portion 505 and two substantially planar opposing fins 506. The fins 506 can be substantially flat or can be at least partially tapered. In addition, the fins 506 can include rounded or shaped leading and trailing edges (not shown). FIG. 6E shows a corona ground element 500E that is substantially ovoid. FIG. 6F shows a corona ground element 500F that includes a substantially ovoid body 505 and two substantially planar opposing fins 506. As before, the fins 506 can be substantially flat or can be at least partially tapered. FIG. 6G shows a corona ground element 500G that has a substantially tear-drop or airfoil cross-sectional shape, including a rounded leading edge 508 and a tapered trailing edge 509. This embodiment can be employed in order to substantially reduce airflow drag and airflow turbulence through the pre-ionizer 930. FIG. 6H shows a corona ground element 500H that has a substantially aerodynamic cross-sectional shape. The corona ground element 500H in one embodiment comprises a substantially symmetrical airfoil shape. The corona ground element 500H can include a substantially rounded leading edge 508, a substantially rounded trailing edge 509, or both. Alternatively, the corona ground element can include a substantially tapered trailing edge 509, as shown in FIG. 6G, and/or a substantially tapered leading edge (not shown). FIGS. 6B and 6D-6H comprise embodiments featuring aerodynamic cross-sectional shapes, wherein airflow around these corona ground elements remains substantially turbulence free and smooth due to the cross-sectional shape.

The corona ground element 500H shown in FIG. 6H is substantially hollow, such as a tube, for example. It should be understood that although the various embodiments are depicted as comprising solid shapes, alternatively any of the corona ground element embodiments can comprise a substantially hollow body.

Figure 6I:
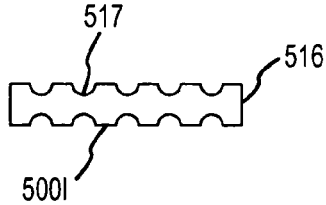

The corona ground element 500I shown in FIG. 6I comprises a substantially planar body 516 that includes a plurality of depressions 517 formed on the body 516. The depressions 517 create a maximal surface area. This embodiment can be used wherein the corona ground element 500I is desired to additionally function as a collector surface for dirt and debris in the pre-ionizer 930.

The various embodiments shown and described above can include the projections 507 shown in FIG. 5. Alternatively, the various embodiments can be formed without the projections 507. Instead, the ends of the various embodiments can be received in indentations, depressions, sockets, fixtures, etc., of the frame 102, as the projections 507 are not required for mounting.

Figure 7A:
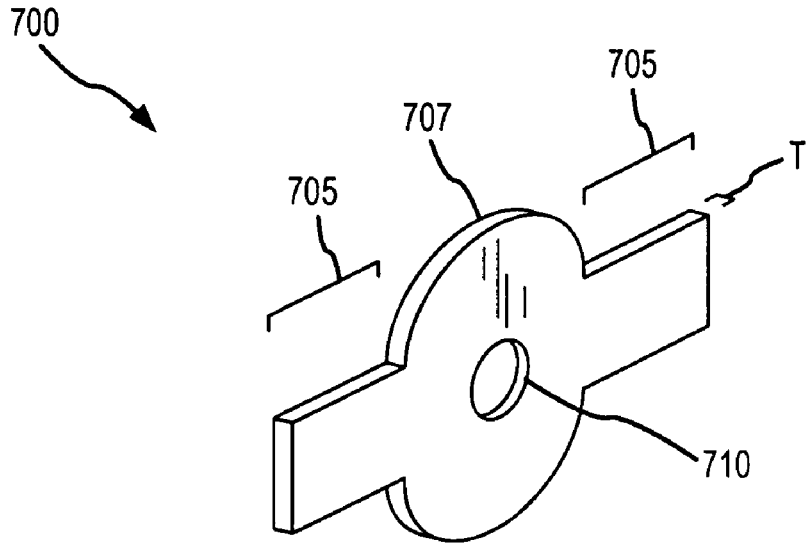
FIGS. 7A-7B show details of a retainer according to an embodiment of the invention.
Figure 7B:
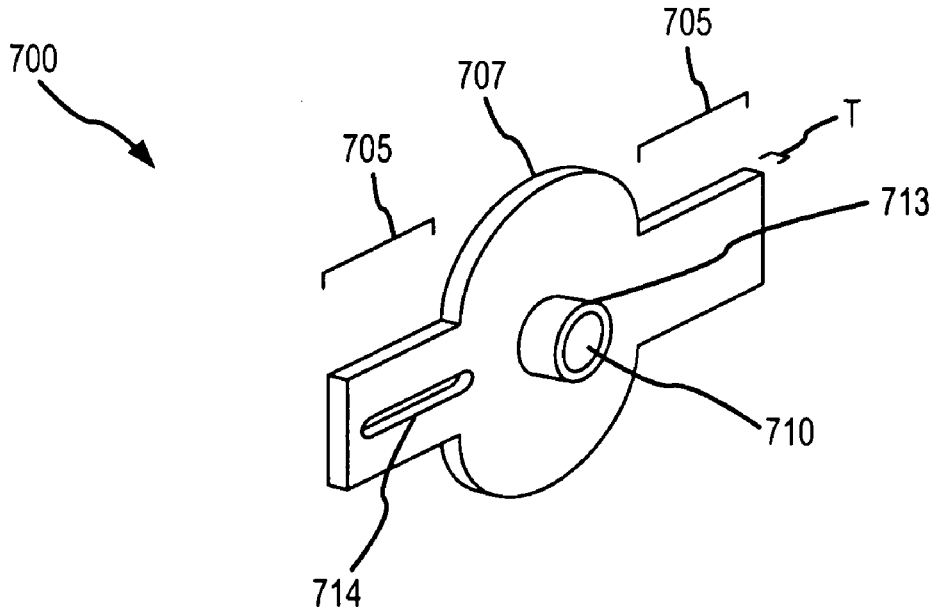

FIGS. 7A-7B show details of the retainer 700 according to an embodiment of the invention. The retainer 700 in the embodiment of FIG. 7A comprises a body including substantially rectangular end portions 705, a substantially circular central portion 707, a thickness T, and a retainer aperture 710. The retainer 700 can be formed of any suitable material, including an at least partially deformable material, an electrically insulating material, an electrically conducting material, etc.

The body in this embodiment is substantially planar. It should be understood that the overall shape is just one embodiment. Other shapes are contemplated and are within the scope of the description and claims.

The retainer aperture 710 receives a projection 507 of one end of a corona ground element 500. The projection 507 can fit into the retainer aperture 710 in a friction or press fit, wherein the retainer 700 traps and retains the corona ground element 500 in a ground element aperture 120 of the frame 102. The retainer 700, by gripping the corona ground element 500, holds the corona ground element 500 in the frame 102. Alternatively, the retainer 700 can be affixed to the corona ground element 500 by a threaded fastener that passes through the retainer aperture 710 and threads into the threaded aperture 504 (see FIG. 5B).

FIG. 7B shows the retainer 700 according to another embodiment of the invention. In this embodiment, the retainer 700 further includes a sleeve portion 713, wherein the sleeve portion 713 can fit at least partially into the ground element aperture 120 of the frame 102. The sleeve portion 713 can be substantially cylindrical. The sleeve portion 713 can be at least partially tapered. The sleeve portion 703 can include the retainer aperture 710, wherein the retainer aperture 710 extends at least partially through the sleeve portion 713. The thickness of the sleeve portion 713 can taper away from the body of the retainer 700. The retainer 700 of this embodiment can be retained in the ground element aperture 120 of the frame 102 by a friction or press fit provided by an outer surface of the sleeve portion 713. A projection 507 of the corona ground element 500 fits inside the retainer aperture 710, and can fit loosely or can be gripped by the retainer 700. The retainer 700 in this embodiment therefore retains the corona ground element 500 by gripping the frame 102.

Alternatively, in another embodiment, the retainer aperture 710 can extend completely through the body and the sleeve portion 713. Consequently, the retainer aperture 710 can receive a fastener that affixes (or removably affixes) the retainer 700 to a corona ground element 500.

The retainer 700 of any embodiment can optionally include one or more alignment devices 714. An alignment device 714 can comprise some manner of projection that fits to and interacts with some manner of depression of the frame 102, such as a slot, groove, etc., in order to prevent movement or rotation of a corona ground element 500. For example, the alignment device 714 can comprise the alignment rib shown in FIG. 7B. Alternatively, the one or more alignment devices 714 can comprise bumps, shafts, shapes, some manner of knurling, texturing or roughening, fins, blocks, etc. Alternatively, in another embodiment, an alignment device 714 can comprise some manner of depression that fits to a corresponding projection on the frame 102.

In one embodiment of the invention, the retainer 700 is affixed or removably affixed to the corona ground element 500 by some manner of fastener, such as a threaded fastener, for example. The fastener can pass through the retainer aperture 710. In some embodiments, the retainer 700 can be clamped against the frame 102 by this fastener.

Figure 8:
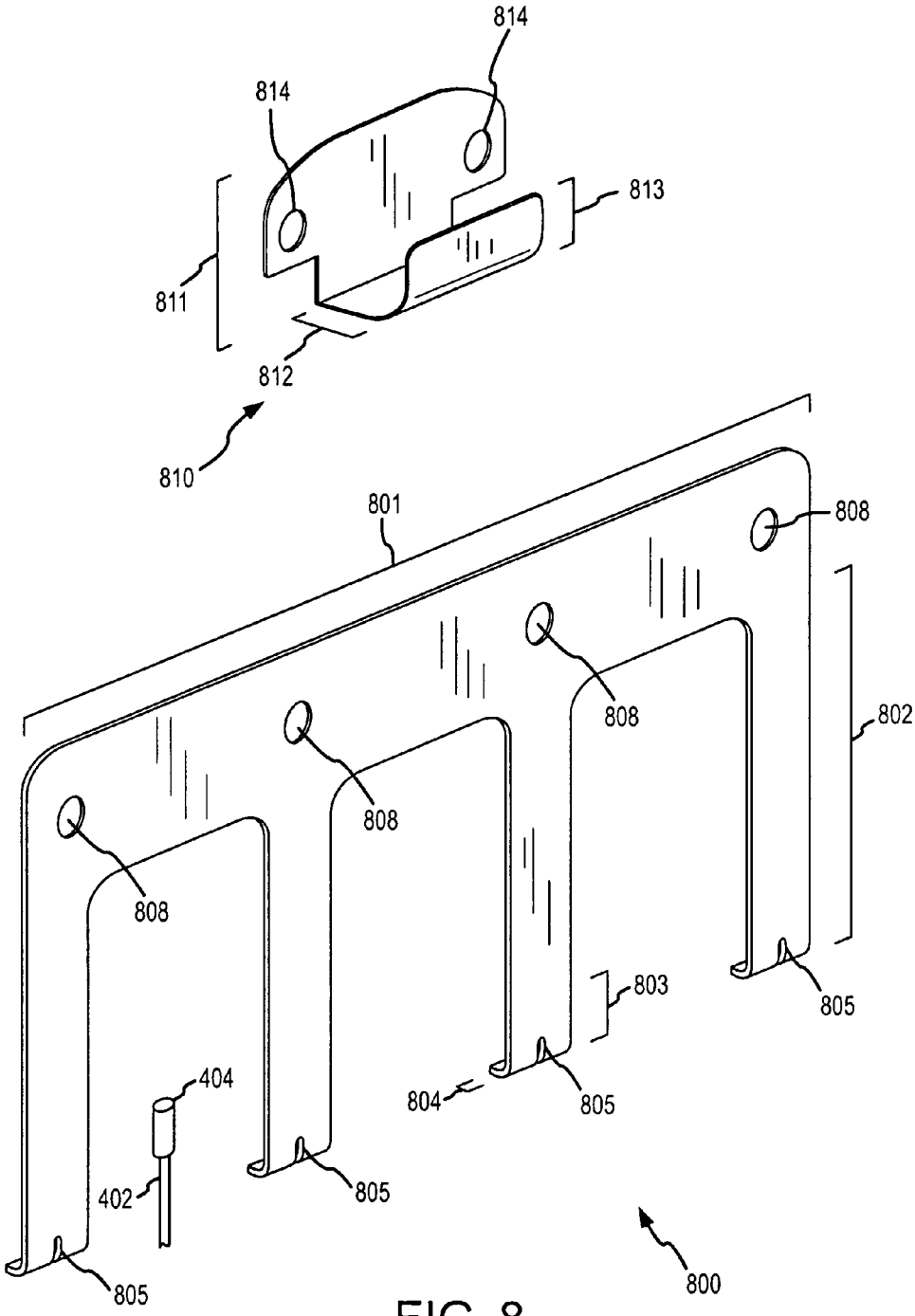
FIG. 8 shows a charge element retaining member and a precipitator contact plate according to an embodiment of the invention.

FIG. 8 shows a charge element retaining member 800 and a precipitator contact plate 810 according to an embodiment of the invention. The charge element retaining member 800 includes a body 801, flexible arm portions 802, and one or more mounting holes 808. In one embodiment, the mounting holes 808 can accept pins 1040 of the frame 102 (see FIG. 10). The element retaining member 800 is contacted by an ionizer contact 1416*a* in the electrostatic precipitator receptacle 1403 (see FIG. 14 and accompanying discussion).

The charge element retaining member 800 in one embodiment is flexible and the flexible arm portions 802 therefore can bend or deform under pressure. The flexible arm portions 802 can retain a number of electrode wires of the electrostatic precipitator cell 104, such as the corona charge elements 400 of the pre-ionizer 930, for example. The flexible arm portions 802 include a retaining portion 804 formed on an outer end 803. The retaining portion 804 extends from a flexible arm portion 802, such as at an angle or at a right angle, and includes a slot 805. The wire portion 402 of a corona charge element 400 fits into the slot 805, and the retaining body 404 of the corona charge element 400 is held by the retaining portion 804.

The charge element retaining member 800 cooperates with the charge element slots 124 of the frame 102 in order to hold the corona charge elements 400. The charge element retaining member 800 fits into the frame 102 (see FIGS. 9 and 10), and can be held in the frame 102 by any manner of pins, slots, ears, springs, fasteners, heat staking, welds, etc. In one embodiment, resilient tabs 1050 of the frame 102 press the charge element retaining member 800 against corresponding rails, ears, etc., in order to retain the charge element retaining member 800. The insertion of a corona charge element 400 is further discussed below in conjunction with FIG. 10.

The charge element retaining member 800 in one embodiment is formed of a flexible, electrically conductive material or at least partially of an electrically conductive material. For example, the charge element retaining member 800 can be formed of a metal material or a metal alloy. Alternatively, the charge element retaining member 800 can be formed of a flexible material that includes an electrically conductive layer, such as a metal plating layer. However, it should be understood that the charge element retaining member 800 can be formed of any suitable material, and various material compositions are within the scope of the description and claims.

Figure 14:
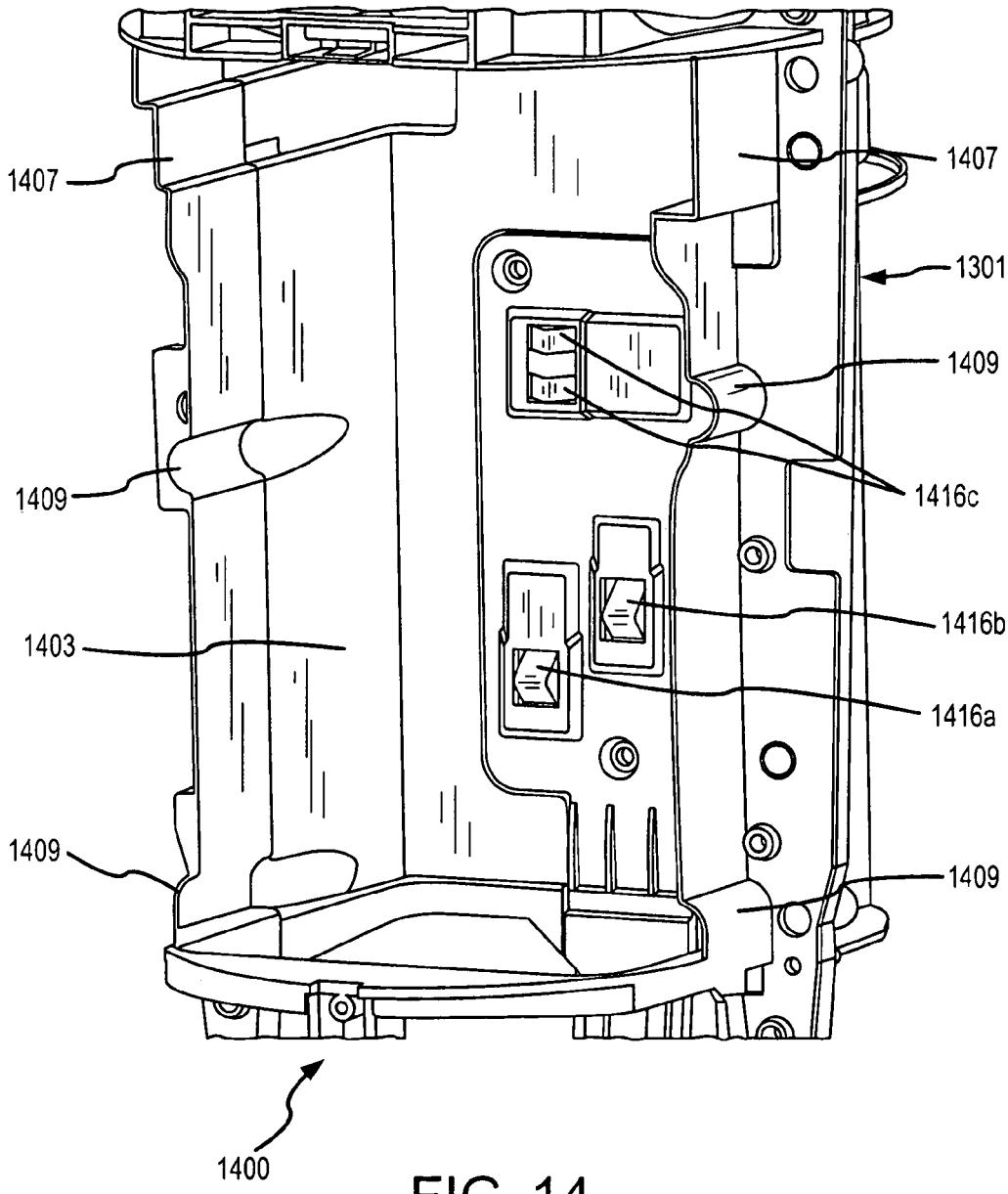
FIG. 14 shows a portion of an air cleaner according to an embodiment of the invention.

The precipitator contact plate 810 provides an electrical contact member between charge plates 160 of the electrostatic precipitator cell 104 and the charge plate contact 1416*b* (see FIG. 14). In one embodiment, the precipitator contact plate 810 comprises an external contact region 811 that is positioned on an exterior of the frame 102, a portion 812 that extends through the frame 102, and a cell contact portion 813 that contacts one or more charge plates 160 of the electrostatic precipitator cell 104. In addition, the precipitator contact plate 810 can include one or more alignment holes 814 that fit over one or more corresponding mounting pins 1040 of the frame 102 (see FIG. 10).

FIG. 9 is a bottom view of the electrostatic precipitator assembly 100 of FIG. 1 looking up into the bottom opening 108. This figure shows the alternating charge plates 902 and collection plates 903 that in one embodiment comprise the plates 160 (see FIG. 1). This figure also shows a portion of a pre-ionizer 930, including the corona ground elements 500 and the corona charge elements 400. The projections 507 of the corona ground elements 500 engage the corresponding ground element apertures 120. In one embodiment, the electrostatic precipitator assembly 100 includes retainers 700 that receive the projections 507 of the corona ground elements 500 and further engage the frame 102, thereby retaining the corona ground elements 500 in the frame 102 (see FIG. 10). It can be seen from the figure that the projections 507 of the corona ground elements 500 in one embodiment do not fully extend through the ground element apertures 120. Alternatively, as previously discussed, fasteners can extend through the ground element apertures 120 and into threaded apertures 504 in the corona ground elements 500.

Figure 10:
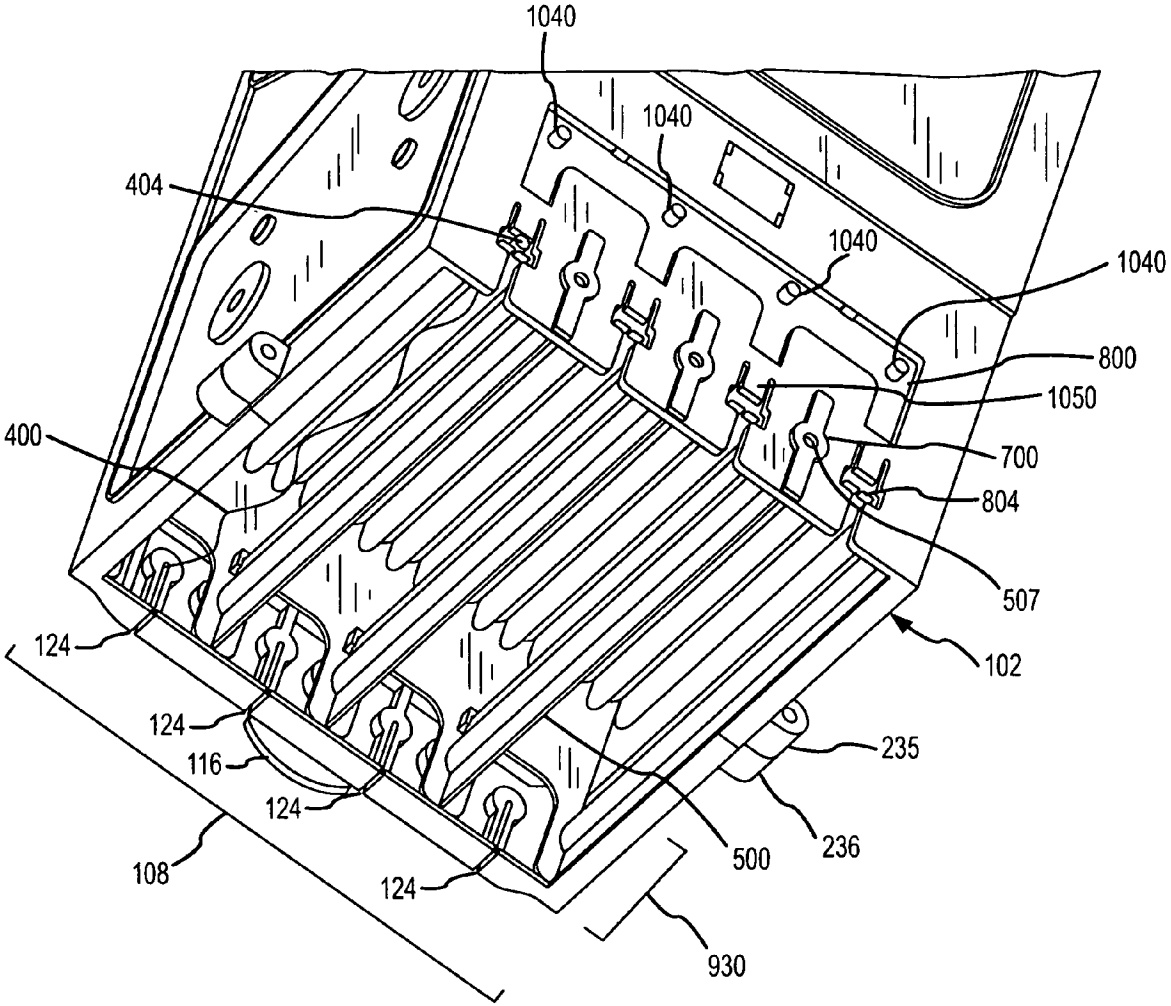
FIG. 10 is another bottom view of the electrostatic precipitator assembly looking up into the bottom opening.

FIG. 10 is another bottom view of the electrostatic precipitator assembly 100 looking up into the bottom opening 108. This figure shows how the projections 507 of the corona ground elements 500 can engage the corresponding ground element apertures 120 according to one embodiment. In the embodiment shown, the retainers 700 receive the projections 507 of the corona ground elements 500 and further engage the frame 102, thereby retaining the corona ground elements 500 in the frame 102. In one embodiment, the retainers 700 engage the ground element apertures 120 through a snap fit or some manner of spring biasing. In another embodiment, the retainers 700 are inserted into the ground element apertures 120 as a press fit requiring an insertion force to press the retainers 700 into the ground element apertures 120. It can be seen from the figure that the projections 507 of the corona ground elements 500 in one embodiment do not fully extend through the ground element apertures 120 and do not extend out of the retainer apertures 710 of the retainers 700.

This figure also shows the one or more mounting pins 1040. The mounting pins 1040 can comprise pins formed as part of or on the frame 102, for example. The mounting pins 1040 can be formed by ultrasonically staking the pins to the frame 102, can be molded into the frame 102, etc. The pins 1040 can hold and/or align the charge element retaining member 800.

Figure 11:
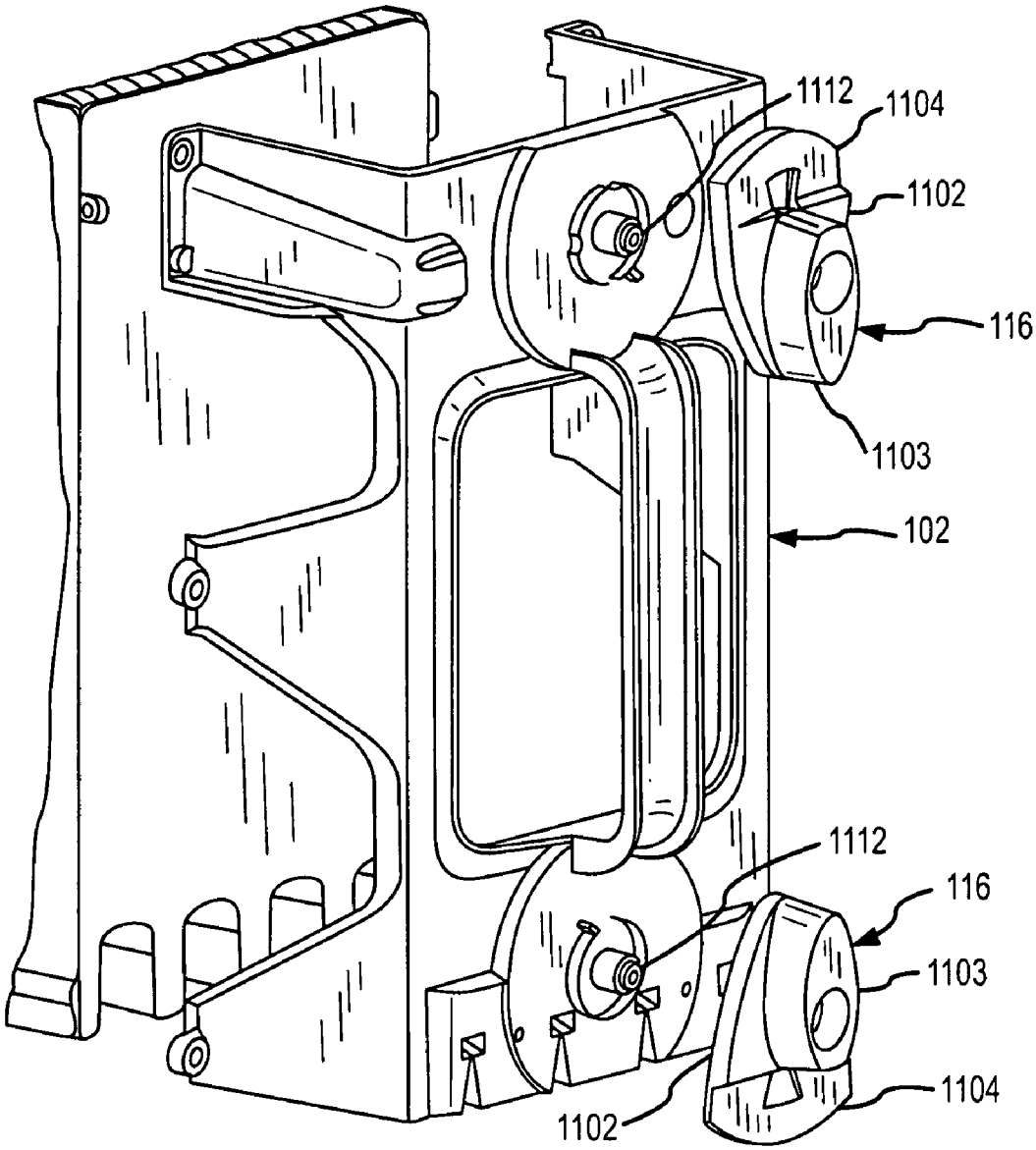
FIG. 11 shows detail of one or more retainer devices according to an embodiment of the invention.

FIG. 11 shows detail of the one or more retainer devices 116 according to an embodiment of the invention. In the embodiment shown, a retainer device 116 includes a base 1102, a handle portion 1103, a wedge portion 1104, an outer aperture 1105, and an inner aperture 1203 (shown in FIG. 12). The base 1102 can be rotatably attached to a stand-off 1112 on the frame 102, such as by fastener devices, for example. In one embodiment, the stand-off 1112 can fit substantially within the inner aperture 1203 (see FIG. 12). The inner aperture 1203 allows the retainer device 116 to rotate around the stand-off 1112.

Figure 12:
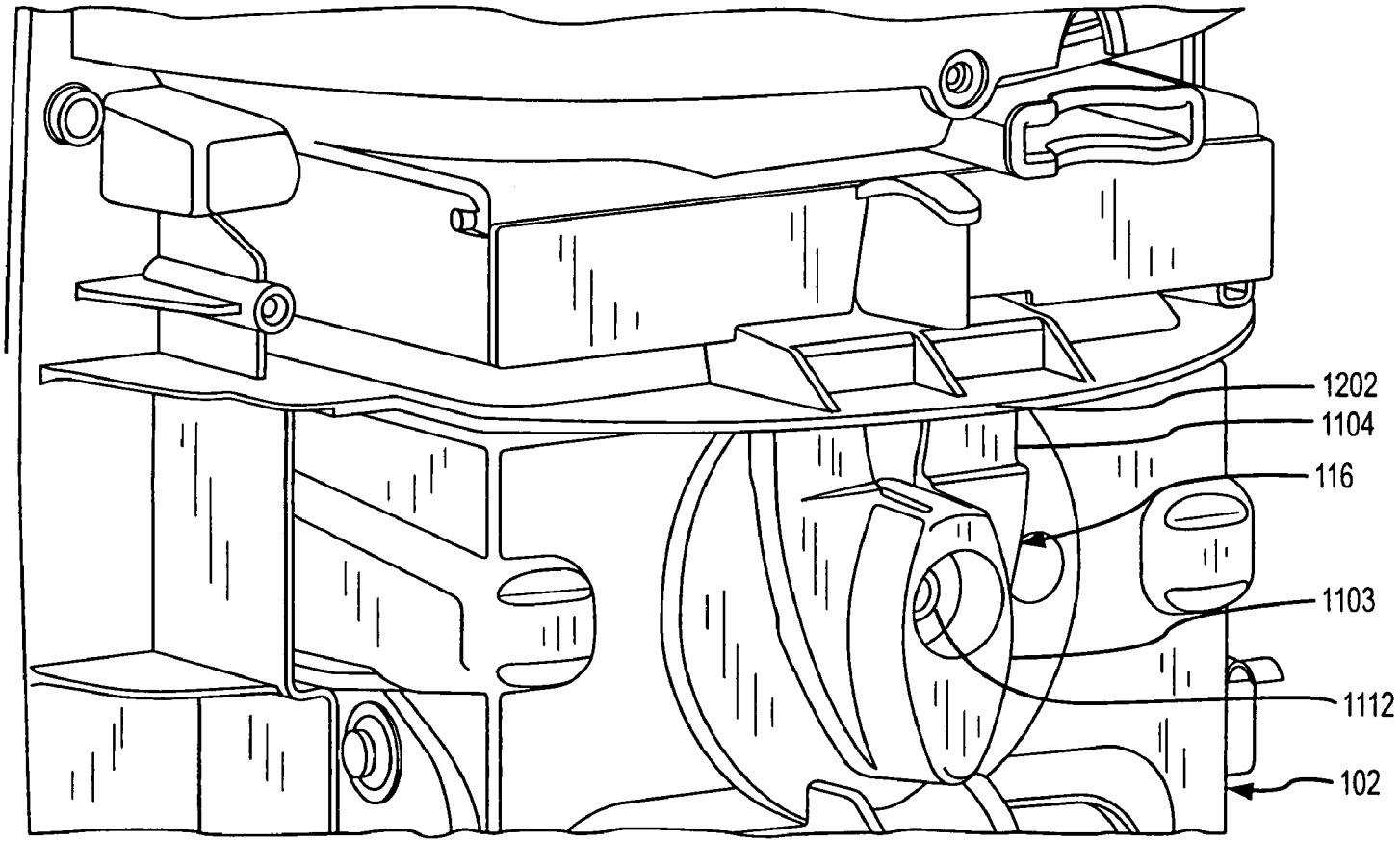
FIG. 12 shows detail of the one or more retainer devices according to an embodiment of the invention.

FIG. 12 shows detail of the one or more retainer devices 116 according to an embodiment of the invention. In the embodiment shown, the handle portion 1103 can be used to rotate the retainer device 116. The wedge portion 1104 fits into a corresponding aperture 1202 of one or more apertures 1202 in the air cleaner chassis 1301. When the one or more retainer devices 116 are rotated in order to engage the one or more apertures 1202 of the air cleaner chassis 1301, the electrostatic precipitator assembly 100 is firmly held in the electrostatic precipitator receptacle 1403. The wedge portion 1104 comprises a portion of increasing thickness that ensures that the retainer device 116 contacts the sides of the aperture 1202 and the retainer device 116 is frictionally held in the aperture 1202.

Figure 13:
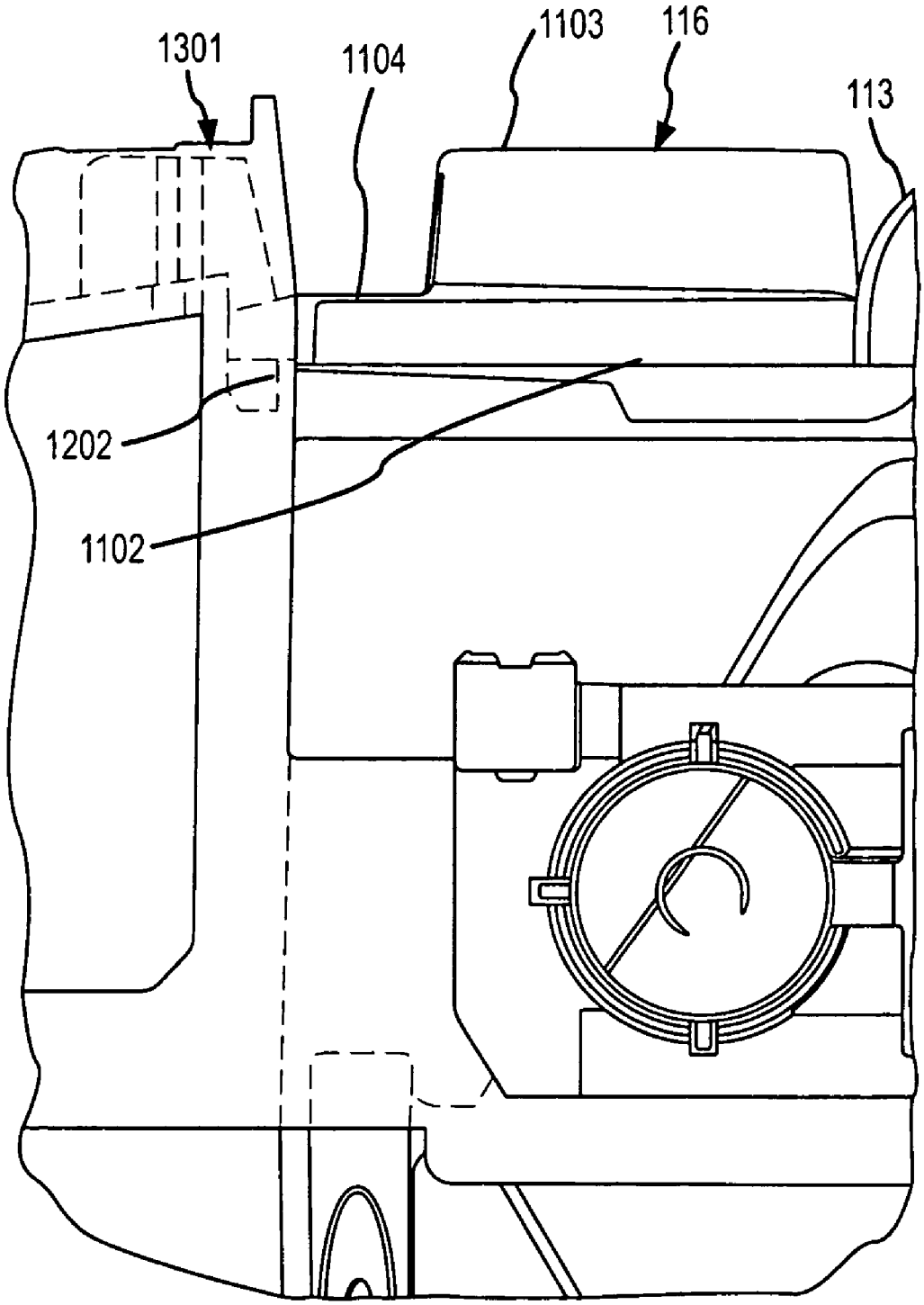
FIG. 13 is a side view that shows the one or more retainer devices according to an embodiment of the invention.

FIG. 13 is a side view that shows the one or more retainer devices 116 according to an embodiment of the invention. This figure shows detail of the retainer device 116, including the handle portion 1103, base 1102, and wedge portion 1104. In addition, this figure shows the aperture 1202 formed in the chassis 1301 and how the wedge portion 1104 extends into the aperture 1202 when the retainer device 807 is rotated to a latch or lock position.

FIG. 14 shows a portion of an air cleaner 1400 according to an embodiment of the invention. The air cleaner 1400 in the embodiment shown can comprise a portion of a tower air cleaner. The air cleaner 1400 in one embodiment includes the chassis 1301, an electrostatic precipitator receptacle 1403, and projection channels 1407 corresponding to the support projections 110 of the frame 102.

The projection channels 1407 are configured to receive the support projections 110 of the frame 102. The electrostatic precipitator assembly 100 hangs in the projection channels 1407 by the support projections 110. Advantageously, this hanging mount enables the electrostatic precipitator assembly 100 to be easily installed and removed, and can provide a mount that offers little airflow blow-by. It should be understood that alternatively the electrostatic precipitator assembly 100 can be supported by other projection channels 1407/1409, or various combinations of projection channels.

In addition, the air cleaner 1400 can include one or more clearance channels 1409. The clearance channels 1409 are configured to receive the assembly ear portions 235 and 236 of the frame 102.

Furthermore, the chassis 1301 can include electrical contacts 1416 that provide electrical power, sensor capabilities, etc., to the electrostatic precipitator cell 104. The electrical contact 1416*a* is contacted by the charge element member 800 in order to provide electrical power to the pre-ionizer 930. The electrical contact 1416*b* is contacted by the precipitator contact plate 810 to provide electrical power to the charge plates 160. The electrical contacts 1416*c* provide a ground for both the pre-ionizer 930 and the charge plates 160.

Figure 15:
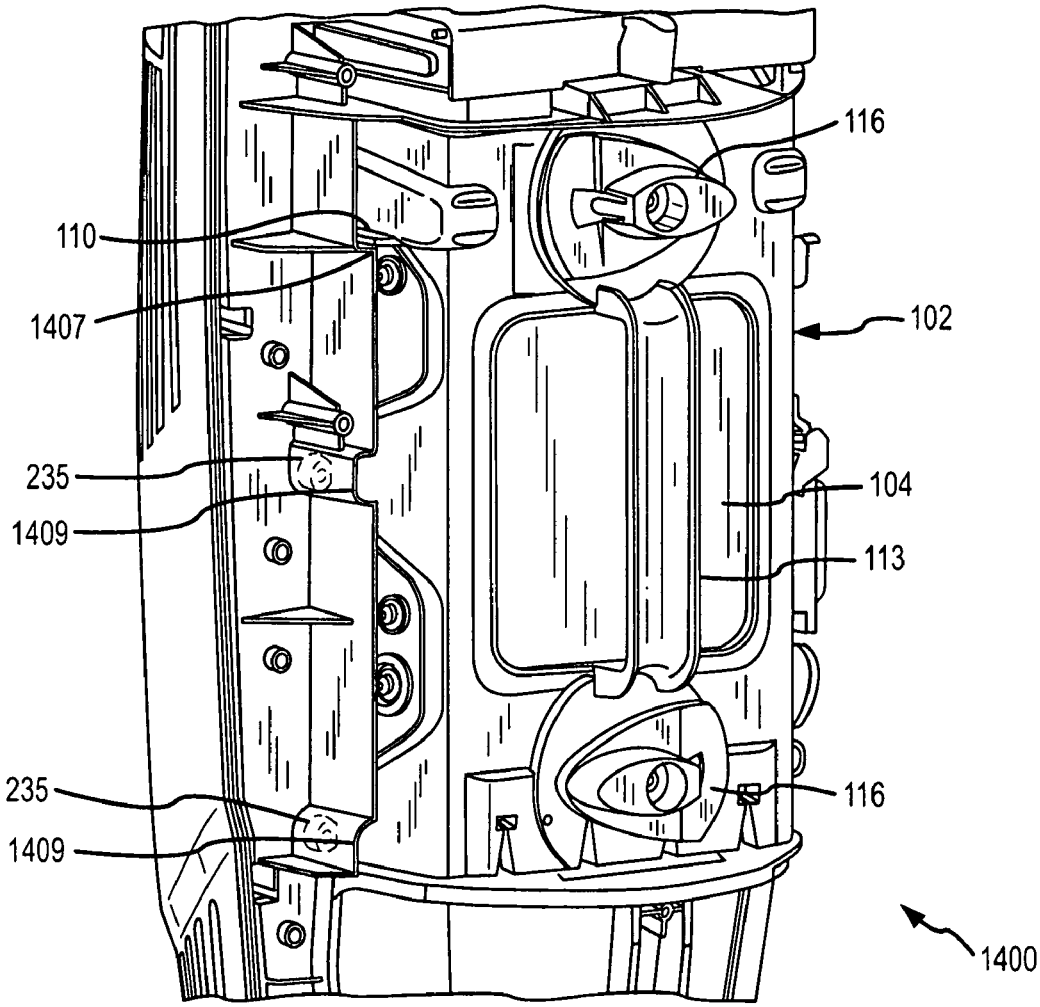
FIG. 15 shows the electrostatic precipitator assembly inserted into the chassis of the air cleaner according to an embodiment of the invention.

FIG. 15 shows the electrostatic precipitator assembly 100 inserted into the chassis 1301 of the air cleaner 1400 according to an embodiment of the invention. The figure shows the air cleaner 1400 where the electrostatic precipitator assembly 100 is fully and completely inserted. In addition, when the electrostatic precipitator assembly 100 is fully inserted, the electrical contacts 1416 of the chassis 1301 can contact the corresponding electrical contacts of the electrostatic precipitator assembly 100 in order to transfer electrical power to the electrostatic precipitator cell 104.

The air cleaner according the invention can be implemented according to any of the embodiments in order to obtain several advantages, if desired. The invention provides a frame that provides structure for pre-ionizer components. The invention provides a frame that advantageously can clamp to electrostatic precipitator cell. The invention provides a frame that includes a handle. The invention provides a frame that includes one or more retainer devices. The invention provides a frame that enables easy manipulation of the electrostatic precipitator assembly for insertion and removal. The invention enables the electrostatic precipitator assembly to be inserted and removed as an integral unit. The invention provides a frame that enables easy manipulation of the electrostatic precipitator assembly for servicing, inspection, troubleshooting, and repair. The invention provides a frame that suspends the electrostatic precipitator cell in the air cleaner chassis. The invention provides a frame that provides an attachment to chassis of air cleaner. The invention reduces the likelihood of shorting or arcing. The invention provides an electrostatic precipitator assembly that does not require seals.

What is claimed is:

1. A frame for an electrostatic precipitator cell, comprising:

a first frame portion adapted to at least partially receive the electrostatic precipitator cell; and a second frame portion adapted to at least partially receive the electrostatic precipitator cell, with the second frame portion directly assembling to the first frame portion to form the frame, wherein the frame includes one or more side portions, an open top end, and an open bottom end and wherein the frame receives and holds the electrostatic precipitator cell.

2. The frame of claim 1, with the frame being further configured to clamp onto the electrostatic precipitator cell.

3. The frame of claim 1, with the frame being formed of an electrically insulating material.

4. The frame of claim 1, further comprising one or more side openings formed in the frame, with the one or more side openings being adapted to reveal a portion of the electrostatic precipitator cell.

5. The frame of claim 1, further comprising:

two or more first assembly ear portions formed on the first frame portion;

two or more corresponding second assembly ear portions formed on the second frame portion; and two or more fasteners configured to affix the two or more first assembly ear portions to the second assembly ear portions.

6. The frame of claim 1, further comprising two or more support projections being formed on the frame.

7. The frame of claim 1, further comprising a handle formed on the frame.

8. The frame of claim 1, further comprising one or more retainer devices which are rotatably attached to the frame, wherein the one or more retainer devices are adapted to engage an air cleaner chassis.

9. The frame of claim 1, further comprising a plurality of ground element apertures formed in the frame.

10. The frame of claim 1, further comprising a plurality of ground element apertures, with a ground element aperture including a weep hole that drains moisture from the ground element aperture.

11. The frame of claim 1, further comprising a plurality of slot wells for receiving a plurality of electrode wire bodies, with a slot well including a corresponding charge element slot leading from an edge of the frame to the slot well.

12. A frame for an electrostatic precipitator cell, comprising:

a first frame portion comprising two or more first assembly ear portions, the first frame portion adapted to at least partially receive the electrostatic precipitator cell;

a second frame portion comprising two or more corresponding second assembly ear portions, the second frame portion assembling to the first frame portion to form the frame wherein the frame includes one or more side portions, an open top end, an open bottom end, and wherein the frame receives and holds the electrostatic precipitator cell; and two or more fasteners configured to affix the two or more first assembly ear portions to the second assembly ear portions.

13. The frame of claim 12, wherein the ear portions are located on the side portion of the first frame portion, and on the side portion of the second frame portion.

14. The frame of claim 12, with the frame being further configured to clamp onto the electrostatic precipitator cell.

15. The frame of claim 12, with the frame being formed of an electrically insulating material.

16. The frame of claim 12, further comprising one or more side openings formed in the frame portion, with the one or more side openings being adapted to reveal a portion of the electrostatic precipitator cell.

17. The frame of claim 12, wherein the first frame portion and the second frame portion comprise first and second frame halves.

18. The frame of claim 12, further comprising two or more support projections being formed on the frame portion.

19. The frame of claim 12, further comprising one or more retainer devices which are rotatably attached to the frame, wherein the one or more retainer devices are adapted to engage an air cleaner chassis.

20. The frame of claim 12, further comprising a plurality of ground element apertures formed in the frame portion.

21. The frame of claim 12, further comprising a plurality of ground element apertures, with a ground element aperture including a weep hole that drains moisture from the ground element aperture.

22. The frame of claim 12, further comprising a plurality of slot wells for receiving a plurality of electrode wire bodies, with a slot well including a corresponding charge element slot leading from an edge of the frame portion to the slot well.

* * * * *

UNITED STATES PATENT AND TRADEMARK OFFICE

CERTIFICATE OF CORRECTION

PATENT NO. : 7,597,749 B2
APPLICATION NO. : 11/488301
DATED : October 6, 2009
INVENTOR(S) : Paterson et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 447 days.

Signed and Sealed this

Twenty-eighth Day of September, 2010

David J. Kappos

David J. Kappos
*Director of the United States Patent and Trademark Office*